United States Patent [19]

Metcalf

[11] Patent Number: 5,016,726

[45] Date of Patent: May 21, 1991

[54] SELF-PROPULSION DEVICE FOR SKATEBOARDS OR THE LIKE

[76] Inventor: Walter W. Metcalf, 9005 Metcalf Rd., Kirtland, Ohio 44094

[21] Appl. No.: 552,315

[22] Filed: Jul. 12, 1990

[51] Int. Cl.[5] ..... B62M 1/14

[52] U.S. Cl. ..... 280/243; 280/251; 280/87.042

[58] Field of Search ..... 280/87.01, 87.041, 87.042, 280/242.1, 243, 251

[56] References Cited

U.S. PATENT DOCUMENTS

| | | | |
|---|---|---|---|
| 2,065,034 | 12/1936 | Strohacker | 280/243 |
| 3,884,501 | 5/1975 | Elias et al. | 280/243 X |
| 4,319,760 | 3/1982 | Romano | 280/243 X |
| 4,515,362 | 5/1986 | Lin | 280/243 X |
| 4,807,896 | 2/1989 | Philippi | 280/243 |

*Primary Examiner*—Charles A. Marmor
*Assistant Examiner*—Kevin Hurley
*Attorney, Agent, or Firm*—Watts, Hoffmann, Fisher & Heinke Co.

[57] ABSTRACT

A self-propulsion device of the type for use with a skateboard or the like comprising, a self-propulsion device which may be mounted, as a unit, for replacement to the existing axle of a conventional skateboard or the like, the self-propulsion device comprising an axle having at least one drive roller rotatably mounted adjacent one end thereof, said axle being non-rotatable and being fixedly secured to a skateboard, the axle mounting thereon at least one spool member which receives a plurality of turns of a pull cord for rotating said spool in one direction upon actuation of said pull cord, a roller member rotatably journaled adjacent the free end of said axle for receiving added rotational force upon actuation of said pull cord, clutch means disposed on said axle between said drive spool and said roller for selectively imparting rotational movement of said spool to said roller, and resilient spring means disposed around said axle adjacent said first drive spool for automatically retracting said pull cord when a user releases said pull cord.

9 Claims, 4 Drawing Sheets

A
a
b
c
1
13
14
15
4
19
52
18
21
54
16
5
50
46
48
23
16
22
17
3
40
6
42
44
2
7
8
S
12
9
9
8
20
20
1

SELF-PROPULSION DEVICE FOR SKATEBOARDS OR THE LIKE

TECHNICAL FIELD

This invention relates to a self-propulsion device for driving an axle shaft and more particularly relates to a self-propulsion device which can be provided, as a unit, for use with skateboards to enable the user to propel the skateboard by simple hand manipulation.

BACKGROUND OF THE INVENTION

Heretofore, skateboards have been well known for many years and have constantly gained popularity for amusement and recreational purposes as well as for competitive purposes, as a sports activity. As known, a skateboard generally has a rigid baseboard upon which the user is capable of standing, and the bottom of the board is provided with two pair of rollers, front and rear, which are typically about 2½ inches in diameter with the wheels being made of various polymeric or rubber compositions. The wheels are connected by an axle (sometimes called trucks) and are supported by bearings on the axle. Typically, the axle is rigidly mounted by a swing-arm structure which enables axial displacement of the axle in response to a leaning motion of the user which provides the steering feature for the skateboard. As known, the user stands on the board and pushes his foot against the ground to accelerate the board. Accordingly, the speed developed by the skateboard is directly proportional to the agility and strength of the user and hence, it is advantageous to provide a skateboard wherein its speed can be increased and/or prolonged without being solely dependent upon the physical endurance and/or strength characteristics of the user.

One prior type of hand-manipulation for a skateboard is disclosed in U.S. Pat. No. 4,319,760 granted Mar. 16, 1982 wherein the skateboard was provided with a unidirectional, slip-clutch transmission in association with a drive chain for driving a sprocket wheel that was attached to the axle (truck) of the board. In another application, there is disclosed in U.S. Pat. No. 4,807,896 issued Feb. 28, 1989 an external power mechanism for a skateboard which required the use of two oppositely threaded spools. The spools were spirally threaded and coupled to the axle (truck) to give additional rotational force to the wheels by a pull cable. The speed is based on the predetermined length of the cable in relation to the diameter of the cable spools.

SUMMARY OF THE INVENTION

In accordance with the present invention, there is provided a self-propulsion device which can be provided, as a kit, for use by the skateboard user. That is, the device may be provided to replace the original rear truck (axle and wheels), and is simply fitted to the right end of the truck with the left end, for example, simply having the standard roller mounted on the truck. The device includes a clutch assembly which operates with one or more rollers and is actuated by a cord manipulated by the user by repeatedly pulling upward on the cord. In the invention, when the cord is not being pulled there is no connection to the drive roller. This roller is free to turn in either direction with no friction from the differential assembly because nothing touches the drive roller when the cord is not being actuated.

In the invention, the device provides at least a two (2) speed output since there may be at least two (2) spools which provide this variable speed output. Also, it will be appreciated that the device can be applied either to the rear or front rollers or both, as desired. Moreover, it will be seen that in the invention the device can be utilized to replace one or both trucks including their associated wheels, and will include the pull cord and pull piece or handle for gripping by the user's hand.

In the invention, it will be seen that there is provided, in effect, a replacement kit for a standard type skateboard which provides external power by simple manipulation of a pull cord. The invention includes means for retracting the cord back onto the associated spool such that the user is ready for the next external power cycle upon such rewinding without interference with the normal operation of the skateboard. Also, in the invention one or more cords may be used on the front and rear of the skateboard to enhance the speed thereof. In the invention, the self-propulsion device has a novel pulley design that allows the cord to be switched from one drive spool to another by single hand manipulation. Accordingly, the present invention can be utilized for acrobatic maneuvers without interference and without any changes to the skateboard.

These and other objects and advantages of this invention will be more fully apparent with reference to the description and the drawings described and appended hereto.

DESCRIPTION OF THE PREFERRED EMBODIMENTS

Figures 1, 3:
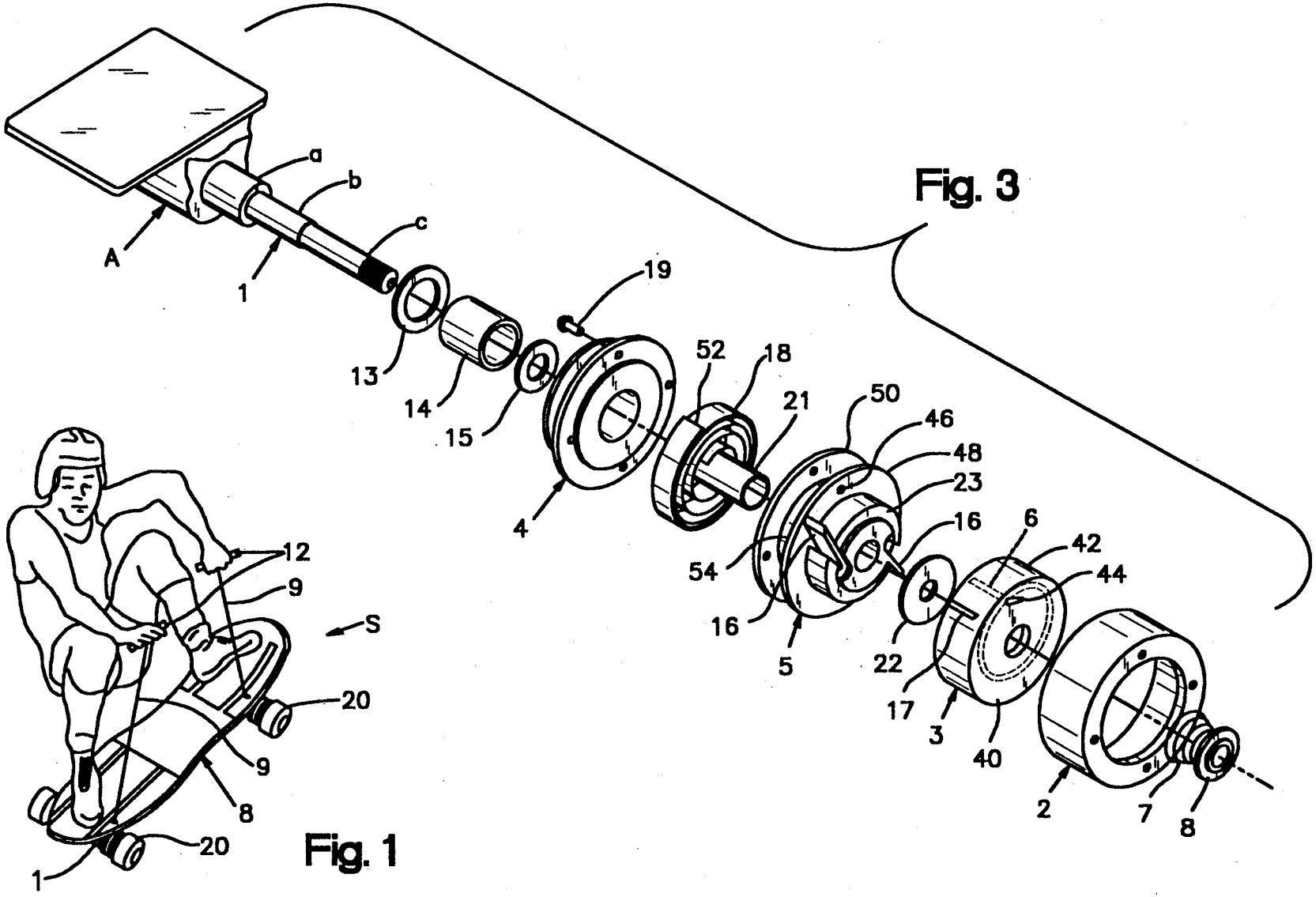
FIG. 1 is a generally perspective view of a standard type skateboard which may be utilized with the self-propulsion device of the present invention.
FIG. 3 is an exploded assembly view illustrating the associated elements comprising the self-propulsion device of the present invention.

Referring again to the drawings and in particular to FIG. 1 thereof, there is illustrated a skateboard, designated generally at S, including a base platform or board B on the bottom surface of which are attached a pair of skate-like rollers, as at 20. The rollers are mounted on axles, as at 1, which, in turn, are carried by swing-arms, as at A. As seen, the user actuates the self-propulsion device, designated generally at P (FIG. 2), by means of a pull cord 9 which has a hand-grip, as at 12, for manipulation by the user for propelling the skateboard forwardly by repeated actuation of the cord in an upward direction.

In the invention, it is important to recognize that the self-propulsion device can be used with and is compatible with conventional skateboards. Accordingly, it will be recognized that the invention may be used with any size skateboard, as desired.

Referring again to FIGS. 2 and 3 of the drawings, it will be seen that the skateboard S includes a base, as at B, which mounts a swing arm A. The swing arm mounts the axle 1 (truck) which axle has three (3) progressively reduced size bore diameters (a), (b) and (c) (FIG. 3) so as to slidably receive and secure thereon the components of the self-propulsion device P. In general, it will be seen that a pull cord 9 is wrapped around a first reduced diameter drive spool 4 which is fixedly secured to the axle by means of a non-rotating sleeve 14. The sleeve 14 is retained by washers 13 and 15. A second drive spool 5 is disposed on another non-rotatable sleeve 21 on the axle. This spool has an increased diameter relative to the spool 4 to increase the acceleration of the roller by reason of increased torque force supplied to the axle upon actuation of the pull cord 9. Accordingly, when the pull cord is actuated it rotates the spools 4 and 5 which causes two resiliently mounted sprag elements, as at 16, carried by a drive hub 23 to engage through axial slots 17 formed in a circular clutch member 3. As seen, the clutch member 3 engages a drive collar that is secured by suitable screws 27 to the associated roller 20. The roller 20, in turn, is mounted on the minimum diameter (c) axle by means of conventional roller bearings, as at 24, mounted on standard inner and outer races 26, as are known in the art.

Figure 2:
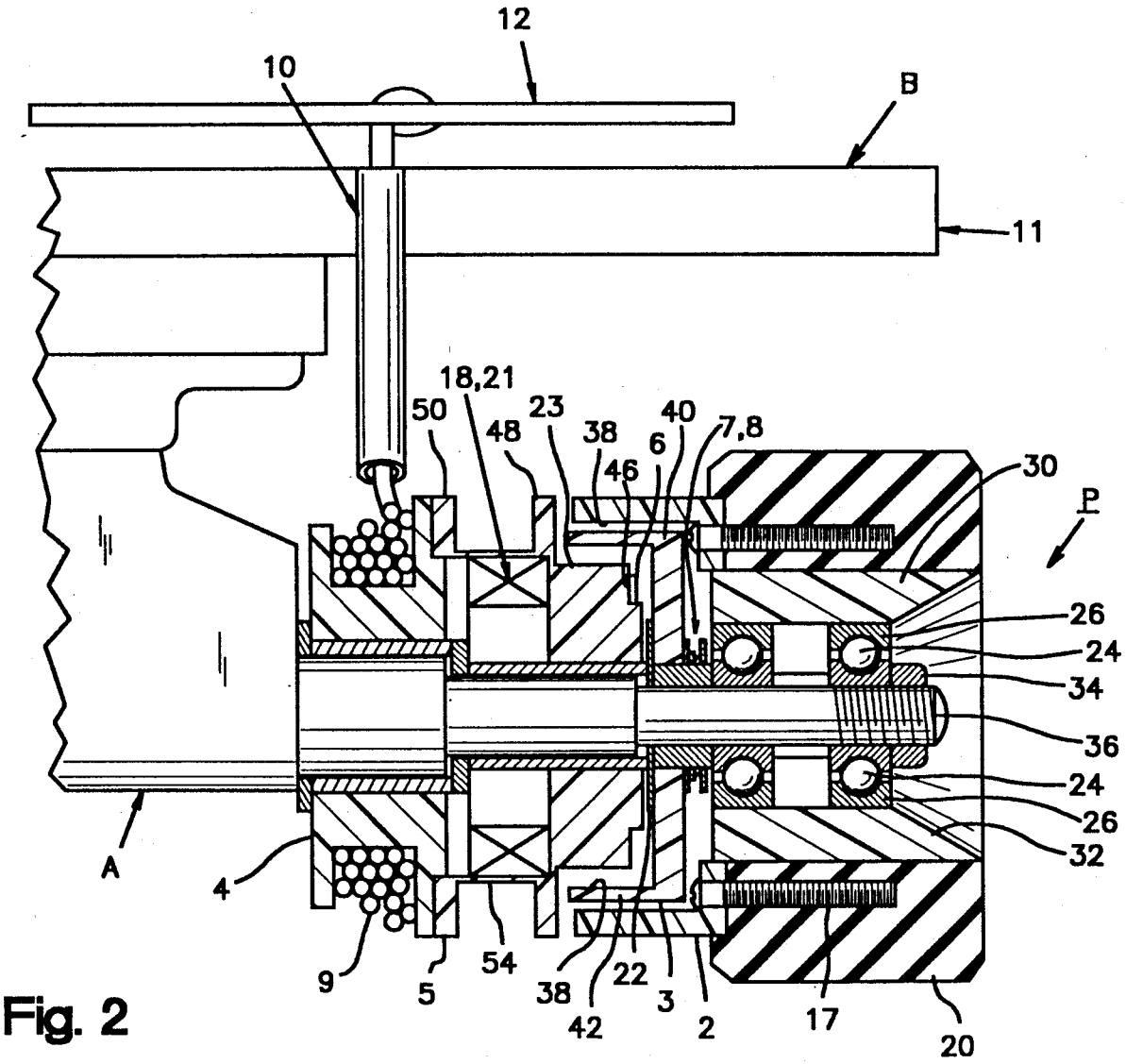
FIG. 2 is a fragmentary, enlarged front elevation view, partly in section, illustrating the self-propulsion device in association with one of the rollers on a truck (axle) of the skateboard.

To drive the roller 20, a bias action is provided by a coiled spring 7 and washer 8 (FIG. 2). The spring bears against the annular clutch member 3 and against another washer 22 which is mounted on the non-rotatable sleeve 21. Engagement is initiated by the clutch-action caused by the resiliency of a spring 6 biasing against the sprag elements 16 and the driven collar member 2.

The cord 9 which may be wrapped either on the smaller 4 or larger 5 diameter spool is returned or rewound by a flat coil spring 18 which is mounted on the sleeve 21 within a hollow cavity in the spool 5. The spring 18 is secured to the sleeve 21 which, in turn, is fixedly secured to the non-rotating axle, as aforesaid. When the pull cord 9 is released the spring 6 (FIG. 2) mounted on the drive hub 23 rotates the clutch member 3 a small amount which, in turn, rotates the sprag elements 16 back and in a direction away from the interior surface of the collar member 2. By this arrangement, it will be seen that the pull cord 9 always returns when released by the user such that there is no drag or connection to the roller 20 when the cord is not pulled or simply held in one position.

It will be seen that the spools 4 and 5 may be secured together by suitable screws, as at 19, for rotation as a unit. This tandem arrangement of the spools enables the user to select two speeds of operation simply by selecting which spool is to receive the cord wrap.

From the foregoing, it will be seen that the acceleration of the skateboard is directly related to the spool diameter and to the length of the pull cord. The length of the cord is determined by the physical characteristics of the user and the placement of the pull grip 12. Accordingly, the usable acceleration of the skateboard will be a function of these two parameters.

Figure 4:
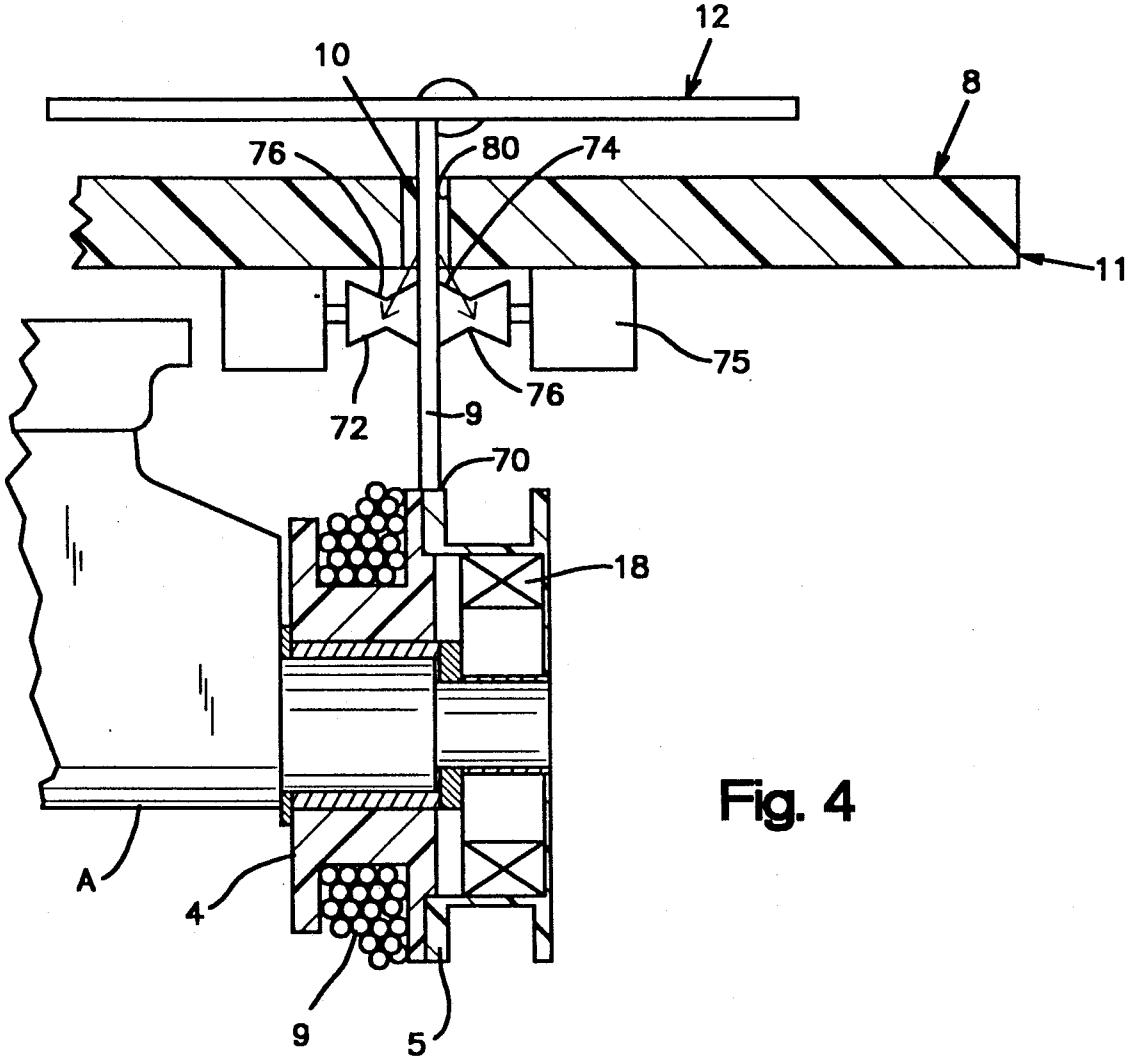
FIG. 4 is a fragmentary section view taken on the line 4—4 of FIG. 1 on an enlarged scale.
Figure 5:
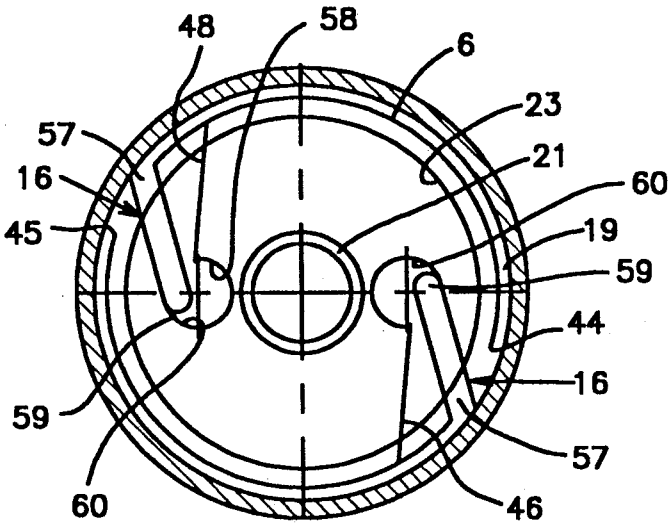
FIG. 5 is an end view of the sprag drive looking in the direction of line 5—5 of FIG. 2 on an enlarged scale.

Now referring more particularly to the drawings and particularly to FIGS. 1 and 3 thereof, it will be seen that the skateboard S may have two (2) pull cords, as at 9, for actuating the rollers, as at 20, which may be disposed on one side of the board. This enables the user to propel the board at a speed which, in effect, is twice that in utilizing a single pull cord. Also, it will hereinafter be seen that the pull cords may be fixedly attached at one end to the drive spools 4 and 5 at the center thereof (FIG. 4) and by reason of a novel pulley design the operator may automatically and relatively easily select one or the other of the drive spools by simply directing the force on the pull cord to the right or left relative to the longitudinal central axis of the skateboard.

For a further understanding of the details of the invention and looking at FIGS. 2 and 3, the roller 20 may be made of a rubber or plastic material such as Teflon or the like. The roller 20 is mounted on an inner angular hub, as at 30, which has a tapered inclined entry and, as at 32, to facilitate securement of the roller via a nut, as at 34, which may be threaded, as at 36, onto the end of the support axle 1. The hub 30 mounts the roller for free rotation via ball bearings, as at 24, which are mounted between the inner and outer race members 26. To the roller 20 is fixedly attached the collar member 2 via screws 27. The inner surface of the collar 2 may be serrated, as at 38, to maximize frictional engagement with the two (2) sprag elements 16 upon actuation of the pull cord 9. Hence, upon actuation of the pull cord 9 the sprags selectively engage and disengage the confronting interior surface via the serrations of the collar 2 which, being fixedly attached to the roller, rotates the roller in the desired direction of travel. Accordingly, when the sprag elements 16 are not engaged the roller 20 including the collar 2 is free to rotate via the roller bearings relative to the clutch member 3.

As aforementioned, the clutch member 3 is of a cylindrical cup-like configuration with a circular base 40 and an integral endless sidewall 42 which has a pair of oppositely disposed radial slots, as at 17, formed therein. The slots 17 slidably receive therethrough the corresponding sprag elements 16 which are loosely held in the integral drive hub 23 on the large diameter drive spool 5.

As seen, the clutch member 3 is resiliently held to the drive hub 23 by means of a coil spring 6 (FIGS. 2 and 3) which is fixedly attached (FIG. 3) at one end, as at 44, to the clutch member 3 and at its other end, as at 46, to the drive hub 23. The clutch member 23 mounts the sprag elements 16 which are resiliently retained by the spring 6. The spring 6 being attached at one end to the clutch member 3 and at its other end to the drive hub 23 acts to wind-up when the drive spool 5 is driven in one direction to force the sprags through the slots 17 and releases in the opposite direction to pull the sprags back out of engagement with the clutch member 3. The spring 6 acts to bias the sprag elements 16 radially inwardly through the slots 17 formed in the clutch member 3.

Figure 8:
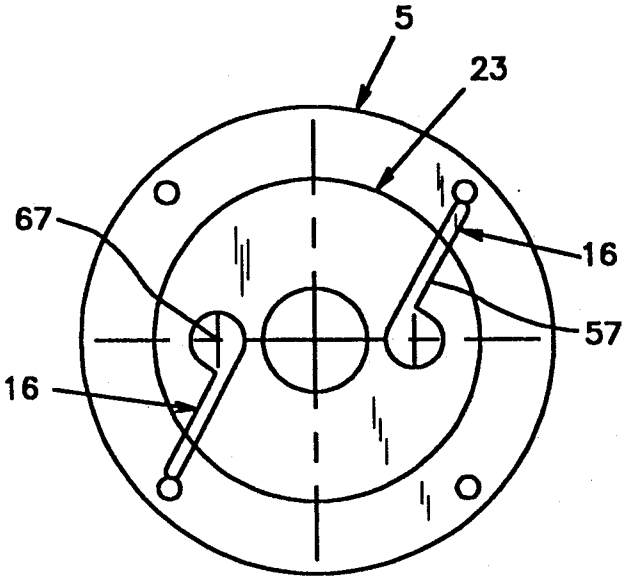
FIG. 8 is an end view of the opposite side of FIG. 6.
Figure 6:
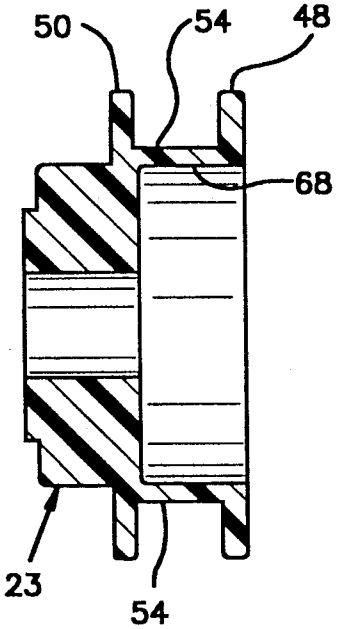
FIG. 6 is a vertical section view of the drive spool and hub removed from the assembly.
Figure 7:
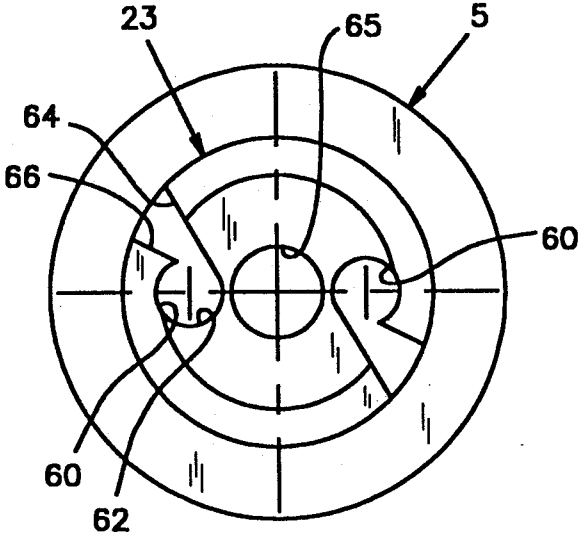
FIG. 7 is an end view of the drive hub of FIG. 6.

The sprag elements 16 each have a tang-like arm 57 (FIG. 8) which have integral rounded retainer portions 59 which are mounted within correspondingly shaped bores 60 formed in the drive hub member 23. As best seen in FIGS. 6, 7 and 8, the drive spool 5 with the integral drive hub 23 is formed with a cut-out cavity, as at 60, defined by a circular portion 62, a linear inclined portion 64 which extends tangentially at an angle of approximately 64° relative to the horizontal plane through the center of a bore 65 formed centrally therein to accommodate the transverse diameter of the sleeve 21 which is mounted on the axle 1. The circular portion 62 mergers at its other end in another linear surface portion 66 which is disposed at an angle of approximately 37° relative to the horizontal axis. The geometric centers of the circular portions 62 of the two cavities 60 are disposed in the same common plane with one another and with the linear portion 64 extending generally parallel to one another. By this construction, the correspondingly shaped sprag elements 16 with the tang-arms 57 and circular portions 59 fit generally loosely in the respective cavities 60 such that the tang arms 57 can pivot (FIG. 8) about the axes 67 and by a slight amount of approximately 27°, as illustrated best in FIG. 7. By this arrangement, the sprag elements 16 are free to move inwardly and outwardly through the slots 17 by the amount of the rotational restrictive movement between the clutch member 3 and the drive hub member 23 relative to one another upon actuation of the pull cord 9. In the invention, it will be understood that any number of sprag elements may be employed, but it has been found that two sprag elements which are diametrically opposed provide preferred satisfactory results. Accordingly, when the drive spool 5 is rotated forward (clockwise as illustrated in FIGS. 1 and 3), the drive hub 23 rotates in a clockwise direction which forces the sprag elements 16 outwardly through the slot 17 into engagement with the serrations 38 on the confronting interior surface of the clutch member 3 which, in turn, engages the roller 24 for driving it forward in a clockwise direction. Upon release of the pull cord 9, the sprag elements 16 are disengaged and hence, drawn inwardly through the slot 17 such that the roller member 20 is allowed to free-wheel on its roller bearings relative to the axle 1. By this arrangement, the spring 6 acts to resiliently bias the tangs 57 of the sprag elements 16 outwardly and inwardly through the slots 17 in the clutch member 3 upon actuation of the pull cord 9.

In the invention, it will be seen that the drive spools 4 and 5, clutch member 3 and driven collar 2 are all mounted in a concentric relationship on the axle 1. Accordingly, these components are loaded onto the axle and retained in a resilient bias relationship via the spring and washer arrangement 7, 8 upon tightening of the nut 34. By this arrangement, the various component parts can be quickly and easily loaded onto the axle for ready repair and/or replacement. The parts because of their concentric inter-fitting relationship, provide a compact assembly that is readily adaptable to being made available in kit form for use with skateboards of conventional construction. By this arrangement, the clutch member 3 is resiliently held for rotation with the spools 4 and 5 upon engagement of the sprag elements 16 upon actuation of the pull cord 9. Accordingly, the clutch member is resiliently mounted on the drive hub 23 of the drive spool 5 such that the sprags 16 which are retained but which are free for radial pivotal movement are free to move through the slots 17 so as to frictionally engage and disengage the confronting interior surface of the drive collar 2 for rotating the roller 20 upon actuation of the pull cord 9.

In the installed position illustrated in FIG. 2, the coil spring 7 and washer 8 act to resiliently bias the clutch member 3 over the drive hub 23 and against the confronting surface of one of two annular flanges 48 and 50 which define the large diameter drive spool 5. A large coiled spring 18 is mounted within a bore 68 in the drive spool 5 (FIG. 6) and is fixedly attached at one end to the sleeve 21 and at its free end, as at 52 (FIG. 3), to the annular spool surface, as at 54, of the drive spool 5 via a suitable hole (not shown) provided in the surface 54. By this arrangement, after actuation of the pull cord 9, the cord can be automatically retracted back onto the spool by the spring 18 after being pulled through all or a partial portion of its length, as desired.

As noted, the spool members 4 and 5 may be integrally attached via screws 19 (FIG. 3) such that they rotate, as a unit, on the support axle upon actuation of the pull cord. In the invention, the pull cord, in another embodiment, may be attached centrally (FIG. 4) of the drive spools 4 and 5, as at 70, and then trained over a pulley, as at 72, mounted on bracket 75 and having a generally hour-glass configuration with an enlarged diameter radius portion 74 disposed centrally between two reduced diameter radius portions 76. The pull cord 9 is then fed through a slot 80 which mounts the pulley 72 and through another slot 82 which is formed in the base B of the skateboard S. Accordingly, by this arrangement the user can exert force on the pull cord 9 either to the left or to the right in relation to the large radius portion 74 of the pulley 72. This enables the user to automatically utilize either the reduced diameter spool 4 or the enlarged diameter spool 5 for selecting the particular drive to axle ratio for delivering a predetermined velocity to the skateboard, as desired.

In the invention, it will be appreciated, therefore, that one or more of the self-propulsion assemblies can be utilized with either the front or rear axle of the skateboard for delivering the amount of acceleration to the board, as desired. It will be seen, therefore, that the self-propulsion assemblies can be provided as an accessory item to a standard skateboard by simply replacing one or more of the standard rollers, as desired. As will be seen in FIG. 1, the user can then actuate one or both of the pull cords to impart reduced or maximum velocity to the board during normal use of the board.

Accordingly, it will be seen that the operation of the self-propulsion device of the present invention does not interfere with riding of the skateboard. The user is free to maneuver the skateboard in a conventional manner. The invention does importantly provide, however, a simple yet reliable adaptive "kit" wherein either the front or rear truck or both may be quickly and easily replaced by adding a truck with only the drive roller and with the other roller being usable as before.

While the invention has been described by reference to what is believed to be the most practical embodiments, it is understood that the invention may embody other specific forms not departing from the spirit of the central characteristics of the invention. Additional changes to the particular spool configurations and diameters are also contemplated within the spirit and scope of this invention. The present embodiments, therefore, should be considered in all respects as illustrative and not restrictive, the scope of the invention being limited solely to the appended claims rather than the foregoing description and all equivalents embraced thereto.

I claim:

1. A self-propulsion device of the type for use with a skateboard comprising, a self-propulsion device which may be mounted, as a unit, for replacement to the existing axle of a conventional skateboard, the self-propulsion device comprising an axle having at least one drive roller rotatably mounted adjacent one end thereof, said axle being non-rotatable and being fixedly secured to a skateboard, the axle mounting thereon at least one spool member which receives a plurality of turns of a pull cord for rotating said spool in one direction upon actuation of said pull cord, a roller member rotatably journaled adjacent the free end of said axle for receiving added rotational force upon actuation of said pull cord, clutch means disposed on said axle between said drive spool and said roller for selectively imparting rotational movement of said spool to said roller, and resilient spring means disposed around said axle adjacent said first drive spool for automatically retracting said pull cord when a user releases said pull cord.

2. A self-propulsion device in accordance with claim 1, wherein a second drive spool member is connected to said first drive spool member and having a larger diameter compared to said first drive spool member, and said spring means being disposed within said second drive spool member.

3. A self-propulsion device in accordance with claim 1, wherein the base of said skateboard has an aperture therein adapted to receive a pull cord therethrough, said aperture being generally centered over said spool members and being connected at one end to said spool members, a pulley member mounted for rotation between said spool members and said aperture, and said pull cord being trained over said pulley whereby actuation of said pull cord of said pulley allows the user to direct wind-up of the pull cord on selective ones of said drive spools.

4. A self-propulsion device of the type which can be installed, as a kit, for use with a skateboard comprising a roller means adapted to be rotatably mounted on a stationary axle, said roller means having a roller member for rolling engagement with the ground and an integral driven annular hub member for rotating the roller member, a drive spool assembly rotatably mounted on said axle and including friction clutch means for engagingly driving said driven hub member for selectively rotating said roller member upon actuation of a pull cord, said drive spool assembly including at least one spool member adapted to receive in wound relation said pull cord, said spool member including an integral drive hub member having one or more sprag elements extending generally radially therefrom, a clutch member mounted for rotation on said axle and resiliently mounted in surrounding relation relative to said drive hub member, said clutch member having one or more axial slots adapted to slidably receive therethrough the associated of said sprag elements, and said sprag elements being adapted for frictional engagement and disengagement with the confronting inner surface of said driven hub member upon actuation of said pull cord for providing a driving coupling between said drive spool assembly and said roller member.

5. A self-propulsion device in accordance with claim 4, wherein said spool member is of a hollow construction and has disposed therein a coiled spring element fixedly attached at one end to said axle and its other end to the spool member adapted to be wound-up in one direction upon actuation of said pull cord, and adapted to be released upon release of said pull cord for winding-up said pull cord in the opposite direction thereof.

6. A self-propulsion device in accordance with claim 4, including a second drive spool member connected to said first mentioned drive spool member and having a different diameter compared to said first mentioned drive spool member for providing variable speeds to said roller member upon actuation of said pull cord.

7. A self-propulsion device in accordance with claim 4, wherein said skateboard has a base having an aperture therein which is generally centered over said spool members, a pulley member mounted on the base of said skateboard below said aperture, said pulley member having an enlarged diameter portion between its ends, and said pull cord being trained over said pulley and being attached at one end to said drive spool members and extending through said aperture and being attached to its other end to a handle member whereby upon actuation of said pull cord the enlarged diameter portion of said pulley enables the user to direct the pull cord laterally for wind-up on selective ones of the drive spool members.

8. A self-propulsion device in accordance with claim 4, wherein said clutch member is of an annular configuration disposed concentrically relative to said driven hub member, said drive hub member being of an annular configuration and concentrically disposed within said annular clutch member, and said sprag elements being attached for pivotal movement in cavities formed in said drive hub member such that such sprag elements are slidably moveable through the slots formed in said clutch member.

9. A self-propulsion device in accordance with claim 4, wherein said drive hub member includes a spring element fixedly attached at one end thereto and fixedly attached at its other end to said clutch member for resiliently connecting said clutch member to said drive hub member.

* * * * *